US005940669A

United States Patent [19]

Bacus et al.

[11] Patent Number: 5,940,669

[45] Date of Patent: Aug. 17, 1999

[54] PRINTER

[75] Inventors: Michael W. Bacus, Spokane; George W. Bowers, Liberty Lake; Paul J. Paroff, Spokane; Reese G. Larson, Spokane; Benjamin L. Egbert, Spokane, all of Wash.

[73] Assignee: Output Technology Corporation, Spokane, Wash.

[21] Appl. No.: 08/951,147

[22] Filed: Oct. 15, 1997

Related U.S. Application Data

[63] Continuation-in-part of application No. 08/887,717, Jul. 3, 1997, abandoned.

[51] Int. Cl.[6] ..... G03G 15/01; G03G 15/16

[52] U.S. Cl. ..... 399/302; 399/308

[58] Field of Search ..... 399/320, 329, 399/327, 302, 308, 111, 113, 322

[56] References Cited

U.S. PATENT DOCUMENTS 5,512,729 4/1996 Kusaka et al. ..... 219/216
5,678,153 10/1997 Okamoto et al. ..... 399/327
5,715,510 2/1998 Kusaba et al. ..... 399/308
5,722,018 2/1998 Hart et al. ..... 399/258
5,758,227 5/1998 Kopp ..... 399/69

*Primary Examiner*—Richard Moses
*Assistant Examiner*—Shival Virmani
*Attorney, Agent, or Firm*—Wells, St. John, Roberts, Gregory & Matkin, P.S.

[57] ABSTRACT

A printer is disclosed and which includes a frame; a movable lifting member borne by the frame; a rotatable pressure drum borne by the frame; a rotatable fusing drum borne by the lifting member; a rotatable image drum borne by the frame and positioned in contact with the fusing drum; an articulation assembly pivotally borne by the frame and movable along a course of travel, the lifting arm engaging the articulation assembly, and wherein movement of the articulation assembly imparts movement to the lifting arm, the lifting arm carrying the fusing drum along a course of travel into, and out of, contact with pressure drum; and an image forming assembly borne by the frame oriented adjacent to the image drum.

74 Claims, 8 Drawing Sheets

PRINTER

RELATED PATENT DATA

This application is a Continuation-in-Part of application Ser. No. 08/887,717 and which was filed on Jul. 3, 1997, now abandoned.

BACKGROUND OF THE INVENTION

1. Field of the Invention

The present invention relates to a printer which has a wide variety of uses, and more specifically to a printer which is capable of printing on a number of different substrates; is flexible in operation; has improved modes of operation; is easy to maintain, and achieves printing speeds not practical heretofore in printers employing related technology.

2. Description of the Prior Art

The prior art is replete with numerous examples of printers, printing assemblies, and printing techniques which have been utilized for various end uses. Examples of such devices and techniques are set forth in U.S. Pat. Nos. 4,910,558; and 5,323,217 the teachings of which are incorporated by reference herein.

The development of various printing techniques and the devices associated therewith have evolved through the years as new substrates have become commercially available.

As a general matter, artisans in the printing trade have been challenged by these new substrates because traditional printing techniques, in many instances, have not achieved the desired print quality when they are used on these same substrates. Further, existing printing technology such as laser type setting, and the use of laser printers, while achieving the desired printing results on many substrates, are not generally considered to be universally acceptable for all substrates because of the operating temperatures which are often realized during these same processes. For example, many synthetic polymeric based substrates which are often used in label stock, and conductive papers cannot withstand the operating temperatures of these same printing techniques without distorting, degrading, or otherwise becoming commercially unacceptable.

Therefore, it has long been known that it would be desirable to have a printer which achieves the benefits to be derived from the related prior art devices and practices while overcoming the shortcomings individually associated therewith.

SUMMARY OF THE INVENTION

Therefore, one aspect of the present invention is to provide an improved printer.

Another aspect of the present invention is to provide a printer which includes a first rotatable drum; a second rotatable drum positioned operatively adjacent the first rotatable drum and movable along a given path of travel; a third rotatable drum positioned operatively adjacent the second rotatable drum; and an electronic image forming assembly mounted operably adjacent the third rotatable drum.

Still another aspect of the present invention relates to a printer which includes a frame; a first rotatable drum borne by the frame; a second rotatable drum borne by the frame and movable along a given course of travel from a first position, where it is in contact with the first rotatable drum, to a second position, where it is positioned in spaced relation relative thereto; a third rotatable drum borne by the frame and positioned in contact with the second rotatable drum; an electronic image forming assembly borne by the frame and mounted operatively adjacent to the third rotatable drum; and an articulation assembly borne by the frame and moving the second rotatable drum along a given course of travel to define various operational conditions of the printer.

Still another aspect of the present invention relates to a printer which includes a frame; a movable lifting member borne by the frame; a rotatable pressure drum borne by the frame; a rotatable fusing drum borne by the lifting arm; a rotatable image drum borne by the frame and positioned in contact with the fusing drum; an articulation assembly pivotally borne by the frame and movable along a course of travel, the lifting arm engaging the articulation assembly, and wherein movement of the articulation assembly imparts movement to the lifting arm, the lifting arm carrying the fusing drum along a given course of travel into and out of contact with the pressure drum; and an electronic image forming assembly borne by the frame and oriented adjacent to the image drum.

Yet still another aspect of the present invention relates to a printer which includes a frame; a movable lifting member borne by the frame; a rotatable pressure drum borne by the frame which is maintained at a first given temperature; a rotatable fusing drum borne by the lifting arm and which is maintained at a second given temperature; a rotatable image drum borne by the frame and positioned in contact with the fusing drum, the image drum being maintained at a third given temperature; an articulation assembly pivotally borne by the frame and movable along a course of travel, the lifting member engaging the articulation assembly, and wherein movement of the articulation assembly imparts movement to the lifting member, the lifting member carrying the fusing drum, along a given course of travel, into and out of contact with the pressure drum, the movement of the articulation assembly defining various operational conditions of the printer; a first rotatable exhaust drum borne by the frame; a second rotatable exhaust drum borne by the articulation assembly; an image forming assembly borne by the frame and oriented adjacent to the image drum; a media engagement assembly positioned operatively adjacent the pressure drum and moving a given media in an appropriate direction relative to the pressure drum; a first heater assembly disposed in heat transferring relation relative to the fusing drum; a second heater assembly disposed in heat transferring relation relative to the media engagement assembly; and a toner dispensing assembly mounted adjacent to the image drum.

A further aspect of the present invention relates to a printer which includes a frame having a channel formed therein; a movable lifting arm borne by the frame; a rotatable pressure drum borne by the frame; a rotatable fusing drum borne by the lifting arm; a rotatable image drum borne by the frame and positioned in contact with the fusing drum; a housing received in the channel and movable therealong to define various operational conditions of the printer, and wherein the lifting arm engages the housing, and wherein movement of the housing along the channel causes the lifting arm to carry the rotatable fusing drum into and out of contact with the pressure drum; a crank borne by the frame; a motor disposed in force transmitting relation relative to the crank; a first crank arm borne by the crank and disposed in force transmitting relation relative to the housing; a second crank arm borne by the crank; a first rotatable exhaust drum borne by the frame; a second rotatable exhaust drum borne by the housing; an image forming assembly borne by the frame and oriented adjacent to the rotatable image drum; a media engagement assembly positioned operatively adjacent the pressure drum; a first heater assembly disposed in heat transferring relation relative to the rotatable fusing drum; a second heater assembly disposed in heat transferring relation relative to the media engagement assembly, the second heater assembly having a shutter, and wherein the second crank arm is disposed in force transmitting relation relative to the shutter; and a toner dispensing assembly mounted adjacent to the image drum.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
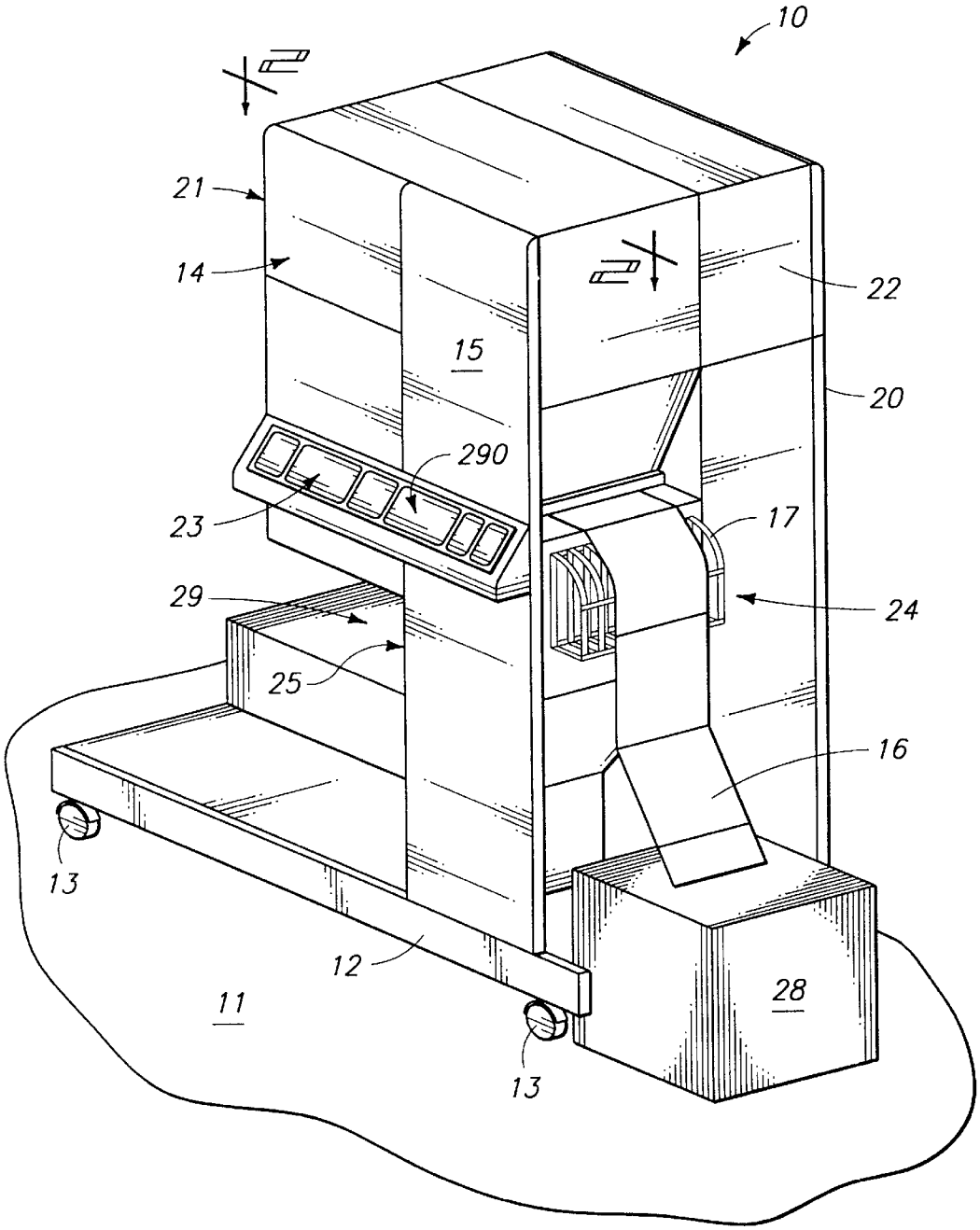
FIG. 1 is a perspective environmental view of the printer of the subject invention shown in a typical operative configuration.
Figure 8B:
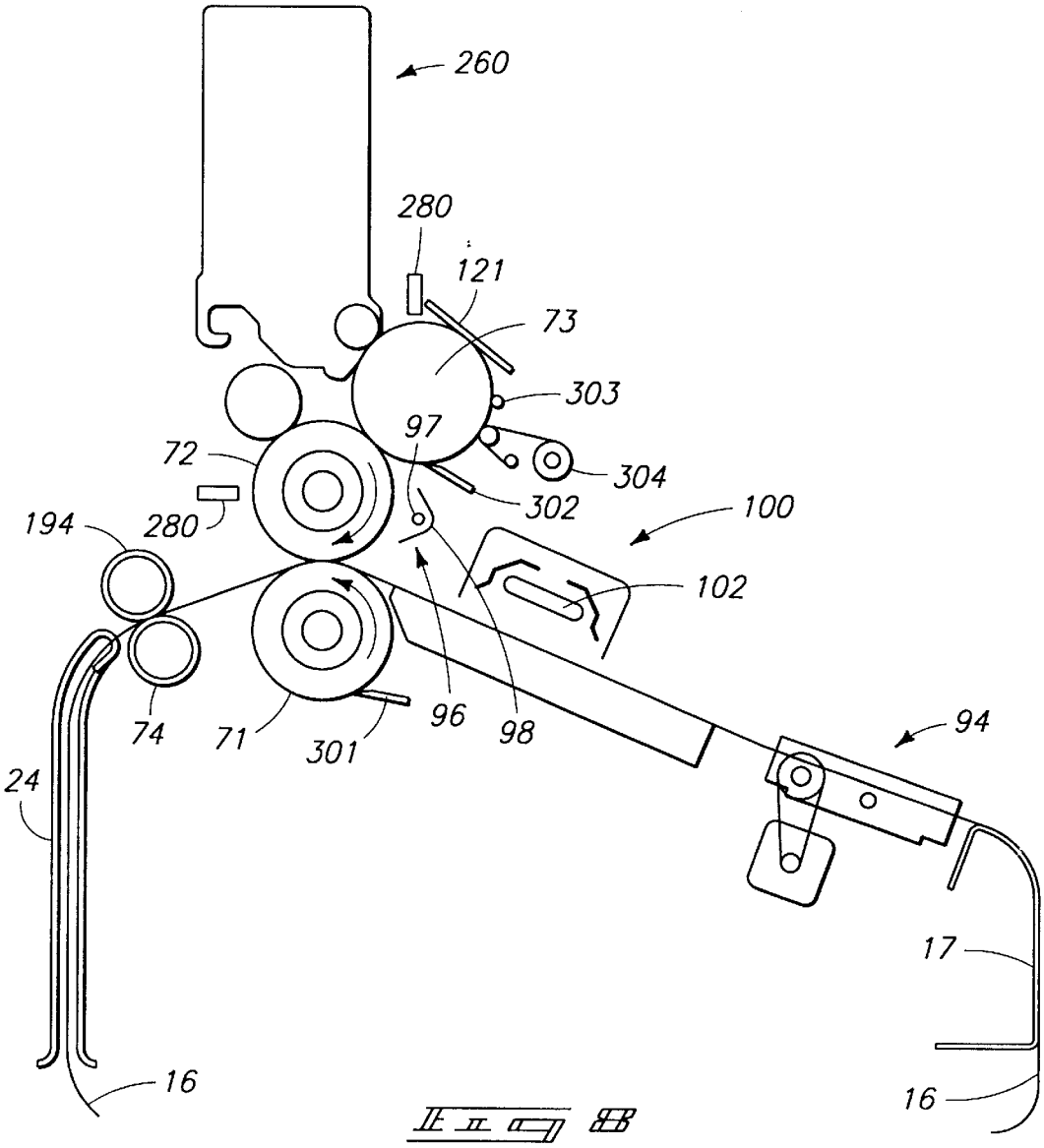
FIG. 8 is a greatly simplified, transverse, vertical sectional view of the present invention and which is taken from a position along line 2—2 of FIG. 1. Many supporting surfaces and structures are removed from this view in order to illustrate the major subassemblies thereof.

The printer of the subject invention is generally illustrated by the numeral 10 in FIG. 1. As shown therein, the printer 10 is placed on a supporting surface 11, and is held in spaced relation therewith by a base portion 12. The base portion includes a plurality of casters 13 which facilitate the movement of the printer 10 across the supporting surface 11. The printer includes a housing 14 which is fastened on the base portion 12. The housing has front and rear surfaces 15 and 20 respectively. Further, the housing has left and right sidewalls 21 and 22 respectively. A control panel 23 which controls the several functions and other operational attributes of the printer 10 (which will be discussed in further detail hereinafter) is made integral with the front surface 15. The right side wall 22 defines a media or substrate intake area 24. A wire form 17 is attached thereto and an aperture is formed therein, (not shown). A suitable continuous substrate or media 16, is taken from a box 28, which is adjacent the printer, across the wire form 17, and into the printer 10 for processing. Further, the left side wall 21 defines a media outfeed area 25. As seen in FIG. 8, a wire form 24 is attached to the left sidewall, in the media outfeed area 25, and is operable to direct the substrate or media 16, which has been processed to a refolding area 29 which is positioned downstream relative to the wire form 24.

Figure 2:
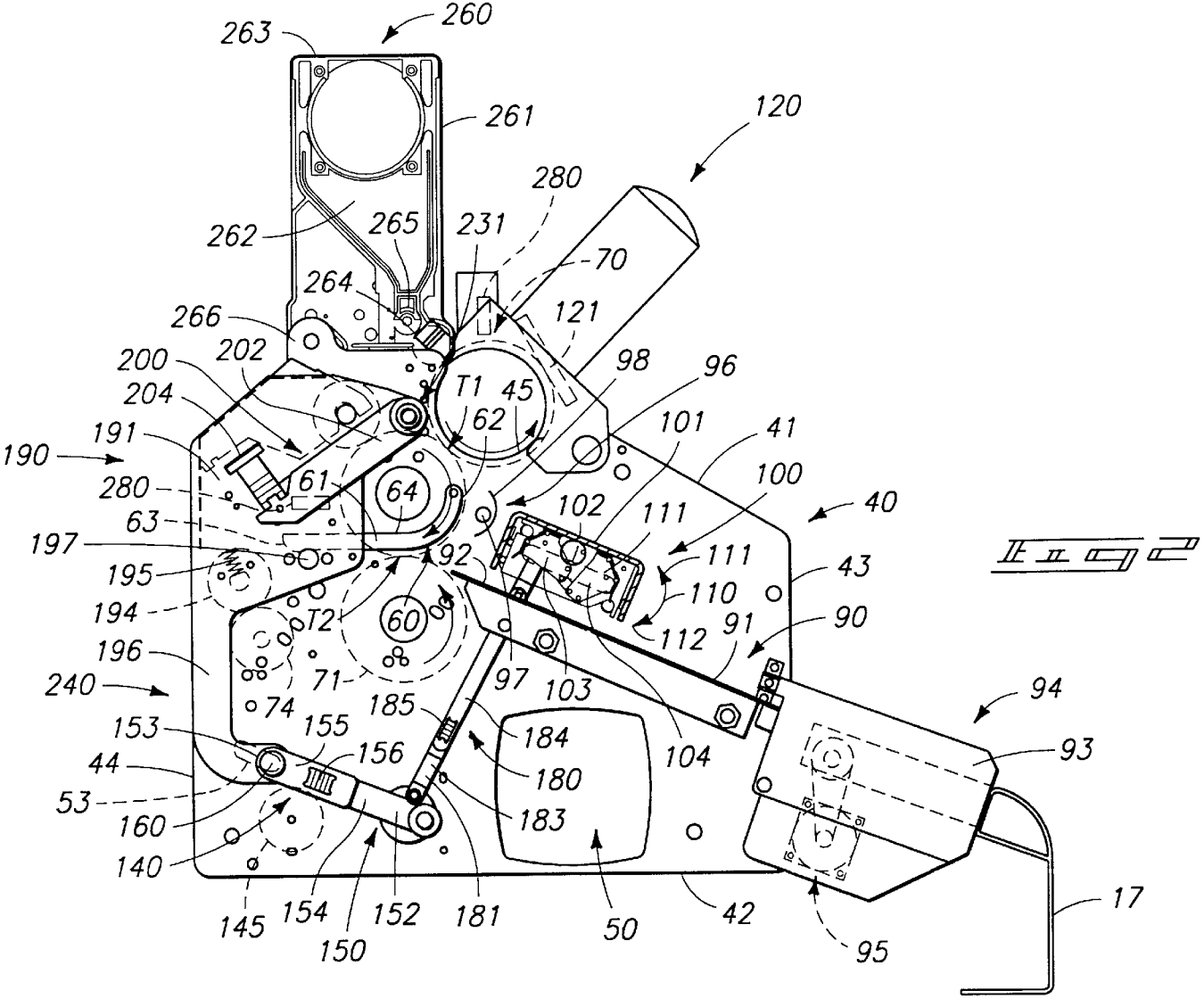
FIG. 2 is a fragmentary, transverse, vertical sectional view of the printer of the subject invention with many supporting surfaces removed to show the detail thereunder. This view is taken from a position along line 2—2 of FIG. 1.
Figure 7:
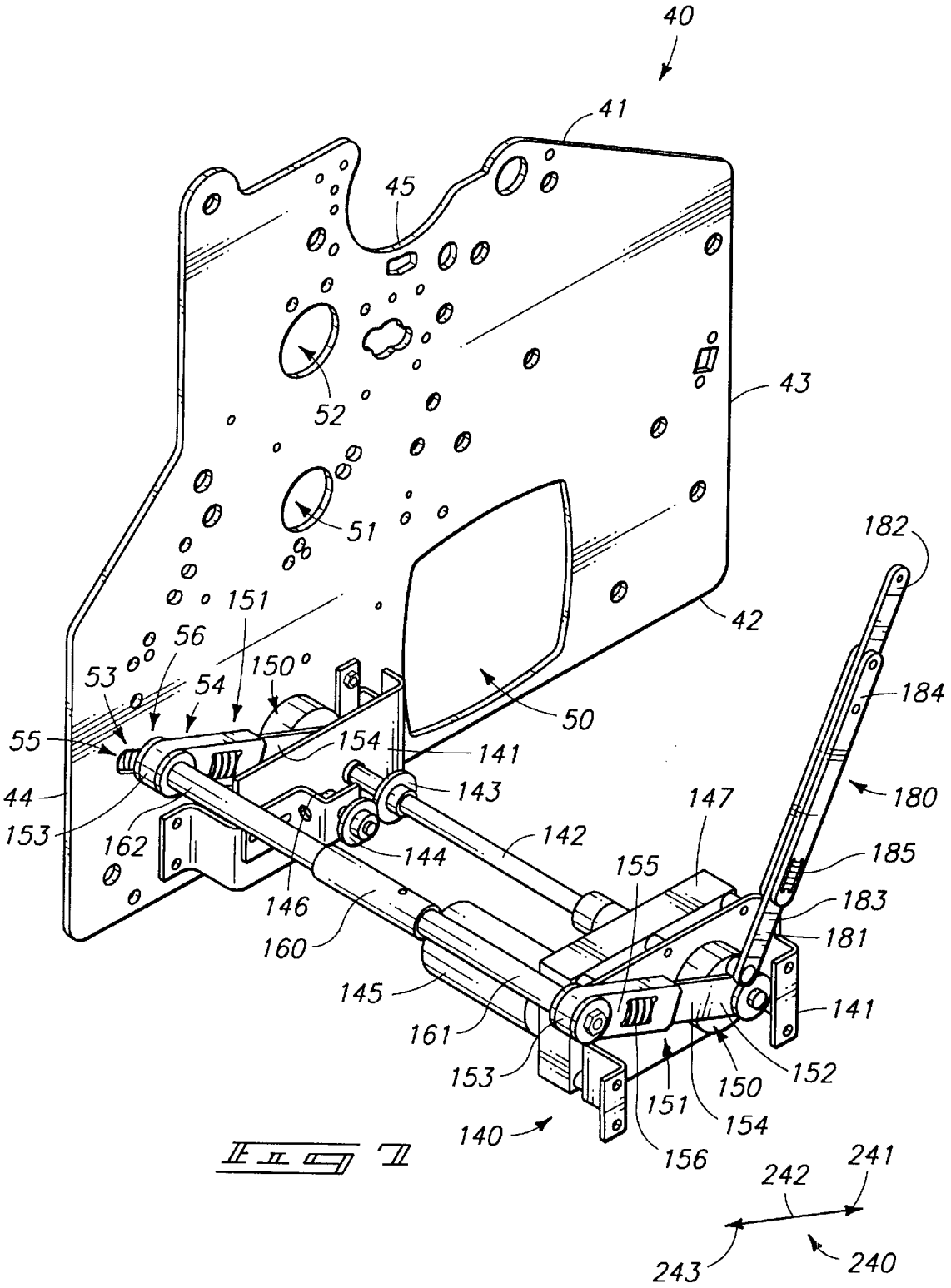
FIG. 7 is fragmentary, perspective view of a portion of the articulation assembly employed with the printer of the present invention.

Referring now to FIGS. 1 and 2, the housing 14 defines a cavity, not shown, and which encloses a frame which is generally indicated by the numeral 40. The frame has two discreet sections, only one of which is shown in the drawings, it being understood that the opposite section of the frame, which is spaced therefrom, will be substantially a mirror image of same. The frame has a top peripheral edge 41, a bottom peripheral edge 42, which rests on the base portion 12, a right peripheral edge 43, and a left peripheral edge 44. As best seen in FIG. 7, a recessed or arcuately shaped portion 45 is formed in the top peripheral edge 41. As further seen in FIG. 7, a number of individual apertures are formed in the frame 40. Among the most important apertures include a motor aperture 50; first and second apertures 51 and 52, respectively; and an elongated channel 53. The elongated channel 53 has a first end 54; an opposite, second end 55; and an intermediate portion 56.

Figure 5:
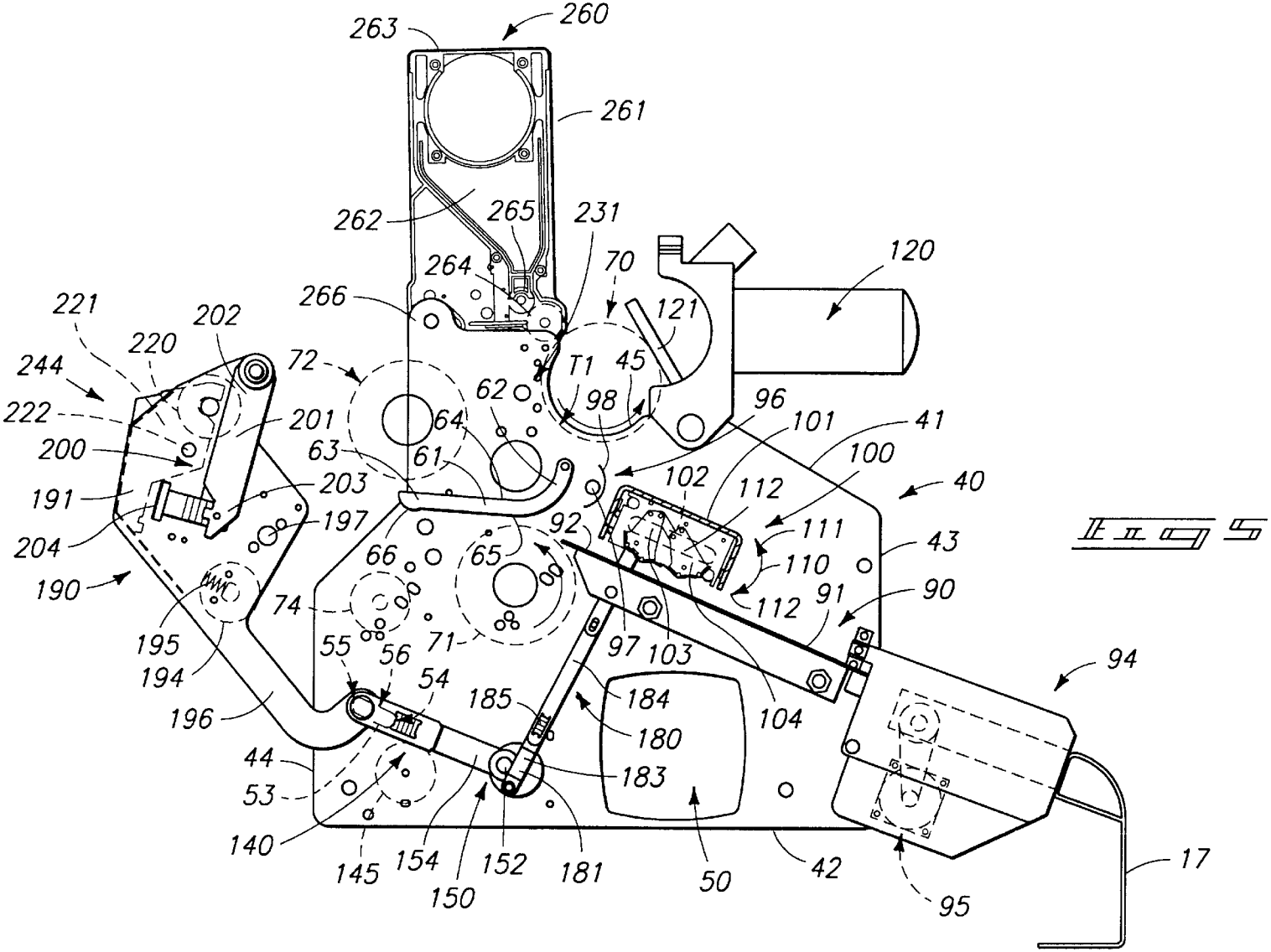
FIG. 5 is a view of the printer shown in FIG. 4 with some structures shown therein in different orientations.

As best illustrated by reference to FIG. 2, a movable lifting member 60 is pivotally secured in an appropriate location on the frame 40. The movable lifting member 60 has an elongated main body 61 which has a first end 62, which is pivotally secured on the frame 40, and an opposite, second end 63 which is remote thereto. Further, the main body 61 has an upper peripheral edge 64 (FIG. 5), and a lower peripheral edge 65. The lower peripheral edge at the second end 63 forms an enlarged engagement surface 66 (FIG. 5).

As seen in FIGS. 2 through 5, a plurality of rotatable drums 70 are mounted on the frame 40 in given orientations one to the others. In this regard, the frame 40 mounts a first or pressure drum 71 in the aperture 51. Further, a second, fusing or transfer drum 72 is supported by the movable lifting member 60 and is placed into contact with the first or pressure drum 71 and is oriented in substantially coaxial alignment with the second aperture 52 (FIG. 7). The image drum is described in more particularity in co-pending application Ser. No. 08/919,521, and which was filed on Aug. 28, 1997. The teachings of that application are incorporated by reference herein. The second or fusing drum 72 is carried by the lifting member 60 along a given path of travel into and out of contact with the adjoining first, or pressure drum 71. Still further, an image drum 73 is rotatably supported by the housing 14 and positioned in the recessed portion 45, which is defined by the frame 40. The image drum 73 is placed in contact with the adjoining second or fusing drum 72. Yet further, a first exhaust drum 74 is mounted in spaced relationship relative to first or pressure drum 71. The respective first, second, and third drums have engagement areas or nips which are designated as $T_1$ and $T_2$, respectively. The amount of pressure existing in the nip $T_1$ is normally about 100 lbs per square inch and the amount of pressure in nip $T_2$ is about 200 lbs per square inch. This nip pressure may be adjusted. Further, the individual nips ($T_1$ and $T_2$) may be selectively opened as will be discussed hereinafter. In addition to the foregoing, each of the respective drums 71, 72, and 73 are maintained at substantially precise temperatures by heating or cooling devices which will be discussed hereinafter. The precise temperatures of the respective drums facilitates the printing process. This feature of the invention will also be discussed in greater detail below. The individual drums 71, 72, and 73 are driven from a single motor and drive belt which engages the third image drum 73. The drive belt and motor have not been shown in the drawings to aid in the understanding of the invention. The individual drums rotate in the direction as illustrated in FIG. 2.

Figure 3:
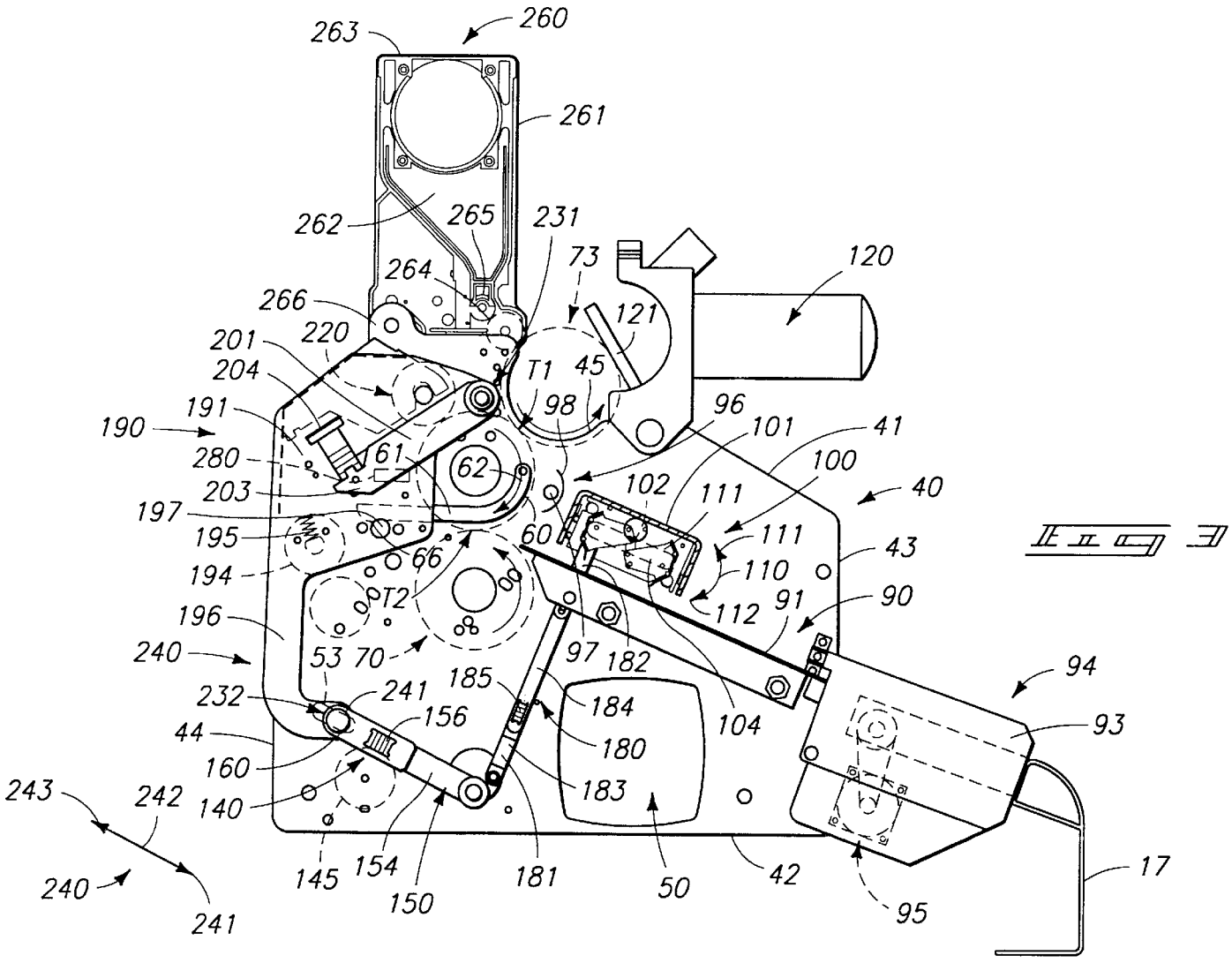
FIG. 3 is a view of the printer shown in FIG. 2 with some structures shown therein in different orientations.
Figure 4:
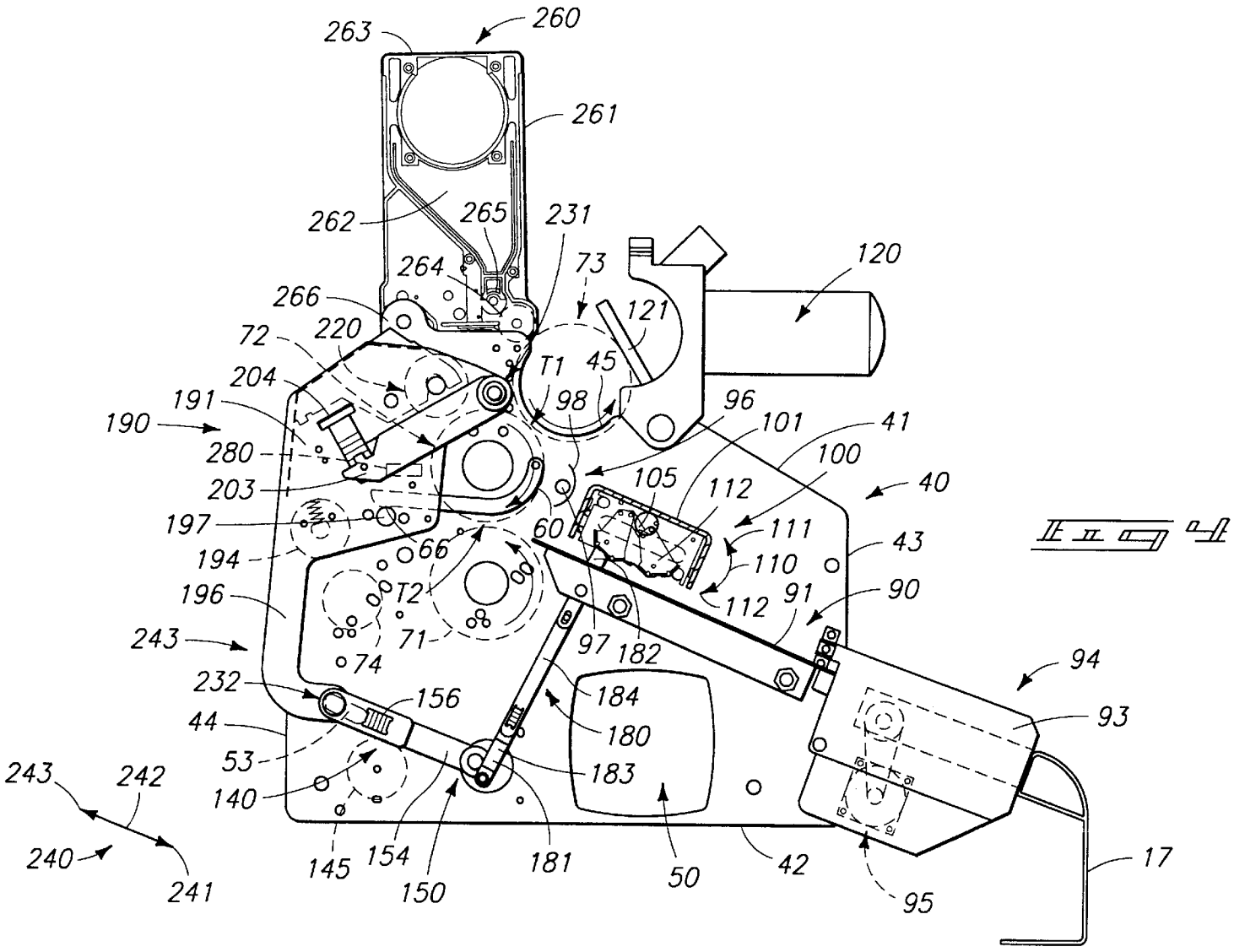
FIG. 4 is a view of the printer shown in FIG. 3 with some structures shown therein in different orientations.

As best seen by references to FIGS. 2, 3, and 4 respectively, a media or substrate engagement assembly 90 is secured on the frame 40. The media engagement assembly 90, as a general matter, is operable to direct the substantially continuous substrate or media 16 along a given path of travel, which is defined by the media engagement assembly 90, into contact with the first or pressure drum 71 such that it is carried or otherwise received in the nip $T_2$ which is defined between the pressure drum 71, and the second or fusing drum 72. The media engagement assembly 90 has a support member 91 which has an upwardly facing surface which supports the media 16 which is to be printed. As seen in FIG. 3, the support member further has a first end 92, which is mounted in close proximity to the first or pressure drum 71, and a second, or opposite end 93. A media propulsion assembly 94, such as a conventional tractor assembly, is mounted on the frame 40. The tractor assembly includes a motor 95. The media propulsion assembly 94 operably engages the media 16, and propels it in the direction of the pressure drum 71 at a speed which is coordinated with the speed of operation of the printer 10. The specifics of the construction of this media propulsion assembly are well known to those skilled in the art and therefore for purposes of brevity is not repeated herein.

As seen in FIGS. 2 and 8, a first heating assembly 96 comprising an infrared lamp 97 and reflector 98 is borne by the frame 40 and disposed in heat transferring relation relative to the second or fusing drum 72. The first heater assembly is operable to maintain the fusing drum at a temperature of less than about 140° C. This heat energy subsequently melts toner which adheres to the fusing drum thereby reducing it to a tar-like consistency. This process will be discussed in further detail, below.

As seen in FIGS. 2 and 3, a second heating assembly 100 is mounted on the frame 40 and disposed in spaced, heat transferring relation relative to the substrate 16 which is traveling nearby. The second heating assembly 100 includes a housing 101 which encloses a heating element 102 of conventional design. The heating element is operable to impart heat energy to the media 16, thereby increasing its temperature. This heat energy facilitates the printing process that will be described, hereinafter. The housing 101 includes first and second shutters 103 and 104, respectively which are pivotally affixed to same and which are movable along given arcuately shaped paths of travel 110. Further, a linkage 105 (FIG. 4) connects the first and second shutters 103 and 104 respectively together. As was noted above, the individual shutters are operable to move along a path of travel 110 between a first or open position 111, wherein heat energy is imparted to the media traveling adjacent thereto; to a second or closed position 112, as shown in FIG. 5, where the shutters 103 and 104 impair the transmission of heat to the underlying media. The motion of the shutters along this path of travel will also be discussed in greater detail hereinafter. The second heating assembly is employed when using substrates which have high thermal absorption capacities. The second heating assembly 100 imparts heat energy to the substrate 16 in order to prevent melted toner from losing too much heat energy too quickly to the substrate thereby interfering with the resulting toner fuse quality.

As shown in FIGS. 2–5 an image forming assembly 120 of conventional design is mounted operatively adjacent the third or image drum 73. The image forming assembly includes a print cartridge 121. A commercially available image forming assembly may be secured from the Delphax Systems, Inc of Mississauga, Ontario, Canada. As a general matter, the image forming assembly 120 works in combination with the third or image forming drum to electrostatically form a predetermined image thereon. The process of forming an image by this means is discussed in detail in the previous prior art references which were discussed above.

As best seen by references FIGS. 2 and 7, the present invention includes an articulation assembly which is generally indicated by the numeral 140. The articulation assembly is pivotally borne by frame 40 and movable along a given course of travel. As should be understood, when the articulation assembly 140 moves, the lifting member 60, which is engagable therewith, is further urged along a path of travel thereby carrying the fusion drum 72 into assorted operational positions relative to the adjoining pressure drum 71. A portion of the articulation assembly 140 is illustrated in FIG. 7. As shown therein the articulation assembly 140 includes a crank frame 141 which is mounted on the frame 40 using conventional fasteners. A crank axle 142 is rotatably borne by the crank frame 141. A gear 143 is fixedly mounted on the crank axle 142, and a driven gear 144 is disposed in force receiving relation therewith. An articulation motor 145 is oriented in power transmitting relation relative to the drive gear 143, and is operable to rotate the crank axle 142 in a given direction. The driven gear 144 is mounted to a potentiometer 146, which will indicate the spacial orientation of the articulation assembly. The articulation motor drives the crank axle by means of a conventional gear box 147. Individual cranks 150 are borne on the opposite ends of the crank axle 142. Still further, individual, first crank arms 151 are attached, on each of the cranks 150. Each of the crank arms have a first end 152, which is pivotally attached on the individual cranks 150, and a second or distal end 153 which is remote thereto. Additionally, each of the first crank arms have a first portion 154 which is pivotally affixed on the respective cranks, and a second portion 155 which is reciprocally slidable therewith. A spring 156 movably affixes the first and second portions together and allows them to move in reciprocally slidable, substantially collinear motion one to the other. A guide member 160 extends between and interconnects the individual second portions 155 at the second end 153, of the individual crank arms 151. The guide member has a first end 161 which is slidably received in one of the elongated channels 53, which is formed in the frame 40, and an opposite second end 162, which is received in the elongated channel (53 or 253???) formed in the opposite portion of the frame 40. As should be understood by a study of FIG. 7, rotational motion of the crank has the effect of reciprocally moving the guide member 160 along the elongated channel 53 between the first and second ends 54 and 55 respectively. This represents a path of travel for the articulation assembly. As earlier discussed, this movement of the articulation assembly causes the lifting arm 60 to carry the fusing drum 72, into and out of, contact with the adjoining pressure drum 71. This can be seen by sequentially studying FIGS. 2, 3, and 4, respectively.

Referring still to FIG. 7, the articulation assembly 140 further includes a second crank arm which is identified by the numeral 180. The second crank arm has a first end 181, and an opposite, second, or distal end 182 which is mounted in force engaging relation relative to the first shutter 103 (FIG. 2) of the heater assembly 100. As with the first crank arm, the second crank arm has first and second portions 183 and 184, respectively, which are slidably joined together by a biasing spring 185. The biasing spring 185 orients the first and second portions in reciprocally slidable substantially coaxial motion, one to the other. As will be recognized by a study of FIGS. 2 through 7, the motion of the crank 150, imparts a corresponding motion to the individual shutters 103 and 104. The significance of this feature will also be discussed in further detail hereinafter.

Figure 6:
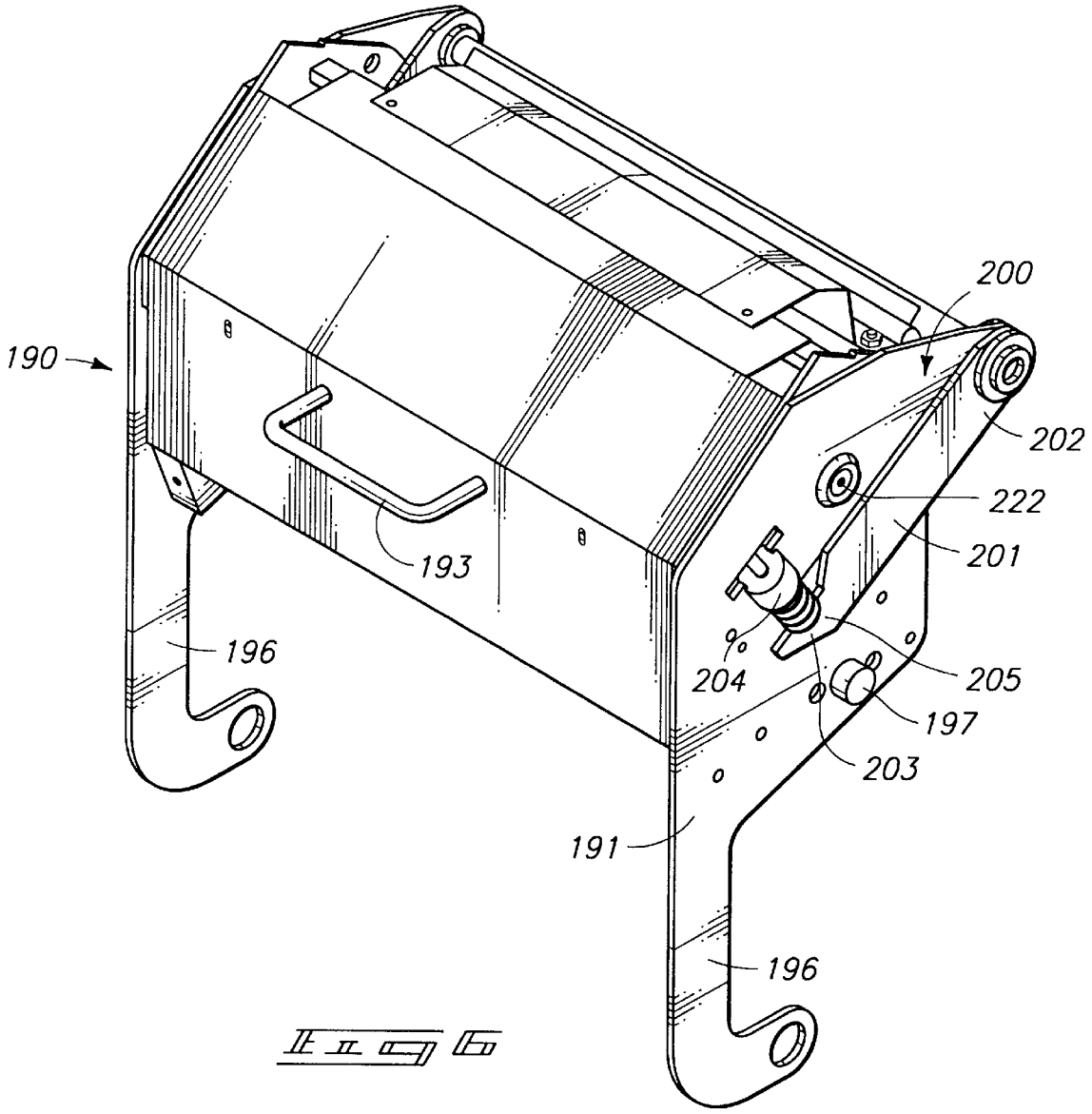
FIG. 6 is a fragmentary, perspective, environmental view of a housing or assembly employed with the printer of the present invention.

Referring now to FIGS. 2 and 6, the articulation assembly 140 further includes an assembly or housing 190. The housing 190 has a main body 191 which includes a handle 193. Referring now to FIG. 2, mounted internally of the housing 190 is a second exhaust drum 194. The second exhaust drum 194 operably engages the first exhaust drum 74 which was described earlier. The second exhaust drum is biased in the direction of the first exhaust drum 74 by means of a biasing spring 195. A motor, not shown, is positioned in driving relation relative to the first exhaust drum 74. When energized, this motor causes the first and second exhaust drums to frictionally cooperate together and move the media being printed through the nip labeled $T_2$. A pair of elongated arms 196 are made integral with the main body 191, and are individually pivotally secured on the respective first and second ends 161 and 162 of the guide member 160 (FIG. 7). This is most clearly illustrated by reference to FIGS. 2, 3, and 4 respectively. The housing 190 further includes a roller/bearing 197 which is engaged by the lifting member 60. In operation as the housing 190 is moved by the respective first crank arms, force is imparted to the lifting members 60 by means of the roller/bearing 197. Further, when the enlarged portion of the lifting arm engages the roller/bearing, the lifting members are operable to move the fusing drum 72 into spaced relation relative to the pressure drum 71. As should be understood, movement of the guide member or shaft 160 (FIG. 7) has the effect of imparting force to the housing 190 thereby moving it along a given path of travel which will be discussed in greater detail hereinafter.

A drum engagement member 200 is movably mounted internally of the housing 190. The drum engagement member has a main body 201 which has a first end 202 which is pivotally affixed on the housing 190; and an opposite, distal, or second end 203 which is remote thereto. A biasing portion 204 is mounted in force transmitting relation relative to the individual second ends. The biasing portion 204 urges the second end 203 in the direction of the fusion drum 72. As can be seen from a study of FIG. 2, the drum engagement member 200 is operable to releasably secure the second or fusing drum 72 in an appropriate orientation relative to the individual lifting arms 60 when the housing 190 is in operable engagement with the frame 40.

The articulation housing 190 further includes a cleaning drum 220 (FIG. 3). The cleaning drum is mounted for movement in the housing 190 by means of a drum frame which is designated by the numeral 221 (FIG. 5). The drum frame 221 rotates about a pivot point 222, and a biasing member (not shown) urges the cleaning drum in the direction of the fusing drum 72 when the housing engages the frame 40. As can be seen by a study of FIGS. 2 through 5, the articulation assembly 140 and more specifically the housing 190 thereof, pivots about several pivot points. In particular, the pivot points include a first pivot point 231, and a second pivot point 232 (FIG. 3). As will be seen by the drawings, (FIGS. 3, 4 and 5) when the housing 190 moves about the first pivot point 231, it defines several operational conditions of the printer 10. Further, when the articulation of housing 190 pivots about the second pivot point 232, the housing 190 can be moved from an engaged position relative to the frame 40, to a spaced, remote location (FIG. 5) such that internal components, such as the fusing drum 72 and other consumables may be readily removed and replaced.

The movement of the housing 190 about the first pivot point 231 defines a path of travel 240 which includes first, second, third and fourth operational positions or conditions which are designated numerically 241–244 respectively. As will be appreciated by studying FIGS. 2 through 5, the path of travel 240 about the first pivot point 231, is defined, in part by the elongated channel 53. In the first operational condition 241 of the printer 10, (the print condition), the fusing drum 72 is in contact with the pressure drum 71 and the image drum 73, and further, the first and second exhaust drums 74 and 194 are in contact, one with the other. Still further, the cleaning drum 220 is in contact with the fusing drum 72. As will be recognized, the articulation housing 190 is positioned at the first end 54 of the channel 53. As the cranks 150, impart force to the first crank arms 151, the housing 190, and more specifically the elongated arms thereof 196 are moved along the elongated channel 53 to an intermediate position 56. This intermediate position 56 defines the second operational condition 242 of the printer 10 (the cleaning position). In this second operational condition 242, the second exhaust drum 194 remains engaged with the first exhaust drum 74. Further, the cleaning drum 220 remains engaged with the fusing drum 72. This second operational condition facilitates the cleaning of the fusing drum 72 of any residue which rests on its surface. Still further, in the third operational condition 243, the elongated arms 196 of the housing 190 are moved to the distal end 55 of the elongated channel 53. In this position, the fusing drum 72 is disposed in spaced relation relative to the pressure drum 71; the cleaning drum 220 is disposed in spaced relation relative to the fusing drum 72; and the second exhaust drum 194 is disposed in spaced relation relative to the first exhaust drum 74 (FIG. 4). This third operational condition 243 is normally considered a non-printing position or stand-by condition. As will be seen in the figures, as the cranks 150 exert force to move the first crank arms 151, it simultaneously is moving the second crank arm 180. As noted earlier, the second crank arm is connected in force transmitting relation relative to the individual shutters 103 and 104 which are made integral with the second heater assembly 100. In the first operational condition 241, (the print condition), the shutters 103 and 104 are in the open position 111. This position of the shutters allows heat energy to be transmitted to the underlying media which is passing nearby. Further, as the housing 190 travels between the first and second ends of the elongated channel 53 the shutters 103 and 104 move from their first, open position 111 (FIG. 2), to a second closed position 112 (FIG. 4). As will be recognized by a further study of FIG. 4, heat energy from the heating element 102 cannot be effectively imparted to the underlying media when the shutters are closed. This substantially prevents distortion or damage to the substrate which may be caused by the presence of excessive heat. Further, as noted above, the housing 190 has a fourth operational condition 244 (a servicing position), which is best seen in FIG. 5. In this operational condition the housing 190 is disposed in spaced relationship relative to the frame 40.

As seen in FIGS. 2 through 5, the printer 10 includes a toner dispensing assembly 260 which is releasably mounted in a given operational orientation relative to the frame 40. The toner dispensing assembly 260 has a main body 261 which defines a storage cavity 262 which receives a given amount of toner to be dispensed, not shown. The storage cavity 262 has an intake end 263, and an opposite exhaust end 264, which is positioned operably adjacent the image drum 73. Mounted in close proximity to the exhaust end 264, and made integral with the main body 261, is a vibration assembly 265 which facilitates the dispensing of the toner from the storage cavity 262. More specifically, when the printer 10 is in the first operational condition 241, the toner dispensing assembly 260 is positioned in an appropriate toner dispensing relationship relative to the image drum 73. However, when the articulation housing 190 is moved to the distal end of the elongated channel 53, thereby placing the printer 10 in the third operational condition 243, the articulation housing 190 urges the toner dispensing assembly 260 into a non-dispensing or spaced relationship relative to the image drum 73.

As best seen in FIG. 8, temperature sensors 280 are individually mounted in heat sensing relation relative to the second and third rotatable drums 72 and 73. The respective heat sensors are enclosed within a housing which maintains each of the heat sensors at a substantially constant temperature of about 50 to about 60° C. The temperature sensors are utilized to control the temperature of both drums. The image drum is maintained ideally at a temperature of less than about 70° C. Further, the pressure drum 71 is maintained at a temperature of less than about 90° C.; and the fusing drum 72 is maintained at a temperature of less than about 140° C. Assemblies to maintain these operational temperatures, and which are well known in the art, are connected in heat transferring, or cooling relation relative to the respective drums. These assemblies are not shown to aid in the understanding of the invention. The printer has a controller assembly 290 which controls the operation of same. This controller assembly coordinates the speeds of rotation of the several drums; the media intake assembly; image forming device; and temperatures of the several drums in order to facilitate the operation of the printer 10.

Referring now to FIG. 8, a greatly simplified view of the present invention is shown, and wherein additional subassemblies are illustrated, and which could not be conveniently and easily shown in the earlier figures. In particular, the present device 10 includes first and second scrapers 301 and 302, respectively and which are mounted in engagement with the pressure drum 71 and the image drum 73, respectively. These scrapers remove gross amounts of particulate matter which may adhere to these respective drums. Further the device 10 includes an eraser rod 303 which is employed to remove the earlier latent electrostatic image which had been placed on the image drum 73 by the print cartridge 121. Yet further, a cleaning assembly 304 comprising a substantially continuous web of material is disposed in wiping relation relative to the image drum 73. This cleaning assembly removes any remaining particulate matter which may adhere to the image drum once it has passed by the scraper assembly 302.

Operation

The operation of the described embodiment of the present invention is believed to be readily apparent and is briefly summarized at this point. As best illustrated by references to FIGS. 2 through 5, the printer 10 of the subject invention includes a first rotatable drum 71; a second rotatable drum 72, positioned operably adjacent to the first rotatable drum 71, and movable along a given path of travel; a third rotatable drum 73 positioned operably adjacent the second rotatable drum 72; and an image forming assembly 120 mounted operably adjacent the third rotatable drum 73.

In a further aspect of the invention the printer 10 includes a frame 40; a first rotatable drum 71 borne by the frame 40; a second rotatable drum 72 borne by the frame 40 and movable along a given course of travel from a first position where it is in contact with the first rotational drum 71 to a second position where it is positioned in spaced relation relative thereto; a third rotatable drum 73 borne by the frame 40 and positioned in contact with the second rotatable drum 72; an image forming assembly 120 borne by the frame 40 and mounted operatively adjacent the third rotatable drum 73; and an articulation assembly 140 borne by the frame 40 and movable along a given path of travel 240 to define various operational conditions of the printer 10.

Yet a further aspect of the present invention concerns a printer 10 which includes a frame 40 having a channel 53 formed therein; a movable lifting member 60 borne by the frame; a rotatable pressure drum 71 borne by the frame 40; a rotatable fusing drum 72 borne by the lifting member 60; a rotatable image drum 73 borne by the frame 40, and positioned in contact with the fusing drum 72; a housing 190 received in the channel 53 and movable therealong to define various operational conditions of the printer 10, and wherein the lifting member 60 engages the housing 190, and wherein movement of the housing 190 along the channel 53 causes the lifting member 60 to carry the rotatable fusing drum 72 into, and out of, contact with the pressure drum 71; a crank 150 borne by the frame 40; a motor 145 disposed in force transmitting relation relative to the crank 150; a first crank arm 151 borne by the crank 150, and disposed in force transmitting relation relative to the housing 190; a second crank arm 180 borne by the crank 150; a first rotatable exhaust drum 74 borne by the frame 40; a second rotatable exhaust drum 194 borne by the housing 190; an image forming assembly 120 borne by the frame 40, and oriented operably adjacent to the image drum 73; a media engagement assembly 90 positioned operatively adjacent the pressure drum 71; a heater assembly 100 borne by the media engagement assembly 90 and having a shutter 103, and wherein the second crank arm 180 is disposed in force transmitting relation relative to the shutter 103; and a toner dispensing assembly 260 mounted adjacent to the image drum 73.

In operation, the controller assembly 290 places the printer in the first operational condition 241 and moves the substrate to be printed up into the nip $T_2$. As the substrate moves past the second heater assembly 100 heat energy is imparted to same thereby raising its temperature. Simultaneously an electrostatic image is formed by the print cartridge 121 of the image forming assembly 120 on the image drum 73. As this electrostatic image passes by the toner dispensing assembly 260, toner is dispensed to same and the dispensed toner clings to the image. As noted earlier, the first, second and third drums are maintained at predetermined temperatures. The deposited toner begins to soften in response to the heat energy imparted to same by the image drum 73. As earlier discussed, the first heater assembly 96 maintains the fusing drum 72 at a temperature of less than about 140° C. The image, defined by softened toner, is transferred from the image drum 73 to the fusing drum 72 at the nip $T_1$. The image which is defined by toner, and which is transferred to the fusing drum 72, continues to increase in temperature, soften further, and melt as a result of the heat energy absorbed from the fusing drum 72. This image is then transferred to the heated substrate 16 as the substrate 16 passes between the pressure drum 71, and the fusing drum 72 at nip $T_2$. The controller assembly 290, as earlier discussed, places the printer 10 in the other operational conditions which were described above. Further, the controller assembly is effective to control the temperatures of the individual drums 70, the speed of operation, and other parameters such that the printer 10 can be employed to print on a wide variety of different substrates and at speeds not possible heretofore.

Alternate constructions are of course contemplated with the invention only being limited by the accompanying claims appropriately interpreted in accordance with the doctrine of equivalents.

We claim:

1. A printer comprising:

a first rotatable drum;

a second rotatable drum positioned operatively adjacent the first rotatable drum, and movable along a given path of travel;

a third rotatable drum positioned operatively adjacent the second rotatable drum; and an electronic image forming assembly mounted operatively adjacent the third rotatable drum, and wherein the first and third rotatable drums are fixed.

2. A printer as claimed in claim 1, wherein the first and third rotatable drums are fixed, and the second rotatable drum is movable along the given course of travel from a first, operational position where it operatively engages the first and third rotatable drums, to a second, non-operational position where it is disposed in spaced relation relative to the first rotatable drum, and wherein the second rotatable drum, when in the first operational position, exerts pressure of a given amount on the first and third rotatable drums.

3. A printer as claimed in claim 1, and further comprising a media engagement assembly positioned operatively adjacent the first rotatable drum, the media engagement assembly moving a given media in an appropriate direction relative to the first rotatable roller.

4. A printer as claimed in claim 3, and further comprising a heater disposed in heat transferring relation relative the media engagement assembly.

5. A printer as claimed in claim 1, wherein a cleaning drum is mounted operatively adjacent the second rotatable roller, the cleaning drum movable along a given course of travel from a first, operational position, where it is disposed in contact with the second rotatable drum, to a second position, where it is spaced therefrom.

6. A printer as claimed in claim 1, wherein the first rotatable drum comprises a pressure drum, the second rotatable drum comprises a fusing drum, and the third rotatable drum comprises an image drum.

7. A printer as claimed in claim 1, wherein a toner dispensing assembly is mounted operatively adjacent the third rotatable drum.

8. A printer as claimed in claim 1, wherein the first rotatable drum comprises a pressure drum, and wherein a media engagement assembly is positioned operatively adjacent the pressure drum to move a given media in an appropriate direction relative to the pressure drum, the media being received between the pressure drum and the second rotatable drum, and wherein the pressure drum and second rotatable drum are maintained at predetermined temperatures.

9. A printer as claimed in claim 1, wherein the second rotatable drum comprises a fusing drum, and wherein a heater is positioned in heat transferring relation relative to the fusing drum.

10. A printer as claimed in claim 1, wherein the second rotatable drum comprises a fusing drum and the third rotatable drum is an image drum, and wherein the image drum and the fusing drum have a surface energy which is substantially equal.

11. A printer as claimed in claim 1, and further comprising a frame for supporting the respective rotatable drums in predetermined operational relation one to the others, and wherein an articulation assembly is borne by the frame and which imparts movement to the second rotatable drum along the path of travel.

12. A printer comprising:

a first rotatable drum;

a second rotatable drum positioned operatively adjacent the first rotatable drum, and movable along a given path of travel;

a third rotatable drum positioned operatively adjacent the second rotatable drum;

a frame for supporting the respective rotatable drums in predetermined operational relation one to the others;

an electronic image forming assembly mounted operatively adjacent the third rotatable drum; and an articulation assembly borne by the frame and which imparts movement to the second rotatable drum along the path of travel, and wherein the articulation assembly pivots about first and second pivot points, and wherein the articulation assembly when pivoting about the first pivot point defines a plurality of operating positions, and wherein the articulation assembly when pivoting about the second pivot point moves along a path of travel.

13. A printer as claimed in claim 12, wherein the first rotatable drum is maintained at a temperature of less than about 90° C.

14. A printer as claimed in claim 12, wherein the second rotatable drum is maintained at a temperature of less than about 140° C.

15. A printer as claimed in claim 12, wherein the third rotatable drum is maintained at a temperature of less than about 70° C.

16. A printer as claimed in claim 12, wherein a temperature sensor is mounted in heat sensing relation relative to the second and third rotatable drums.

17. A printer as claimed in claim 16, wherein the temperature sensor is mounted in spaced relation relative to the second and third rotatable drums.

18. A printer as claimed in claim 17, wherein the temperature sensor is enclosed in a heat sink, the temperature of the heat sensor being maintained at a temperature of at least about 50 to about 60° C.

19. A printer as claimed in claim 12, and further comprising a controller assembly which controls the operational speed of the printer.

20. A printer as claimed in claim 12, and further comprising a toner dispensing assembly which is positioned adjacent the third rotatable drum, and wherein the toner dispensing assembly has intake and exhaust end, and wherein the exhaust end includes a vibration assembly for imparting vibratory motion to the toner received at the exhaust end.

21. A printer as claimed in claim 12, and further comprising:

a first rotatable exhaust drum positioned in spaced relation relative to the first rotatable drum; and a second rotatable exhaust drum positioned in spaced relation relative to the first rotatable drum and operatively adjacent the first rotatable exhaust drum, the second rotatable exhaust drum movable along a given path of travel.

22. A printer comprising:

a frame;

a first rotatable drum borne by the frame;

a second rotatable drum borne by the frame and moveable along a given course of travel from a first position where it is in contact with the first rotatable drum, to a second position, where it is positioned in spaced relation relative thereto;

a third rotatable drum borne by the frame and positioned in contact with the second rotatable drum;

an electronic image forming assembly borne by the frame and mounted operatively adjacent the third rotatable drum; and an articulation assembly borne by the frame and moveable along a given course of travel to define various operational conditions of the printer.

23. A printer as claimed in claim 22, wherein the first rotatable drum comprises a pressure drum, the second rotatable drum comprises a fusing drum, and the third rotatable drum comprises an image drum.

24. A printer as claimed in claim 23, and further comprising:

a cleaning drum borne by the articulation assembly;

a first rotatable exhaust drum borne by the frame; and a second rotatable exhaust drum borne by the articulation assembly.

25. A printer as claimed in claim 24, wherein the course of travel of the articulation assembly comprises a first position wherein the first and second exhaust drums are disposed in force transmitting relation, one to the other, and the cleaning drum is disposed in contact with the fusing drum, a second position wherein the fusing and pressure drums are moved out of contact, one with the other, and the cleaning drum is moved out of contact with the fusing drum; and a third position wherein the fusing drum may be removed from the frame.

26. A printer as claimed in claim 25, wherein the frame further comprises a moveable lifting member which supports the fusing drum, the moveable lifting member cooperating with the articulation assembly as it moves along its respective path of travel, the lifting member supporting the second rotatable drum.

27. A printer as claimed in claim 26, wherein the moveable lifting member urges the fusing drum out of contact with the pressure drum as the articulation assembly moves along its respective course of travel.

28. A printer as claimed in claim 23, and further comprising a media engagement assembly positioned in feeding relation relative to the first rotatable drum, the media engagement assembly moving a given media in an appropriate direction relative to the first rotatable drum.

29. A printer as claimed in claim 28, and further comprising a heater disposed in heat transferring relation relative the media engagement assembly.

30. A printer as claimed in claim 22, wherein the third rotatable drum is maintained at a temperature of less than about 70° C.

31. A printer as claimed in claim 22, wherein a temperature sensor is mounted in heat sensing relation relative to the second and third rotatable drums.

32. A printer as claimed in claim 31, wherein the temperature sensors are mounted in spaced relation relative to the second and third rotatable drums.

33. A printer as claimed in claim 31, wherein the temperature sensor is enclosed in a heat sink, the temperature of the heat sensor being maintained at a temperature of at least about 50 to about 60° C.

34. A printer as claimed in claim 22, and further comprising a controller assembly which controls the speed of operation of the printer.

35. A printer as claimed in claim 22, and further comprising a toner dispensing assembly which is positioned adjacent the third rotatable drum, and wherein the toner dispensing assembly has intake and exhaust ends, and wherein the exhaust end includes a vibration assembly for imparting vibratory motion to the toner which is received at the exhaust end.

36. A printer as claimed in claim 24, and further comprising a media engagement assembly positioned operatively adjacent the first rotatable drum, the media engagement assembly moving a given media in an appropriate direction relative to the first rotatable drum; and a heater disposed in heat transferring relation relative the media engagement assembly, and wherein the heater further includes shutters which are moveable along a given course of travel.

37. A printer as claimed in claim 36, wherein the articulation assembly comprises:

a housing pivotally borne by the frame, and moveable along a given course of travel;

a crank borne by the frame;

a first crank arm borne by the crank and disposed in force transmitting relation relative to the housing; and means for imparting predetermined rotational movement to the crank.

38. A printer as claimed in claim 37, wherein the housing mounts the cleaning drum and the second exhaust drum.

39. A printer as claimed in claim 38, wherein the cleaning drum and the second exhaust drum are biased in a given direction.

40. A printer as claimed in claim 38, wherein the housing mounts a drum engagement member which forcibly engages the fusing drum.

41. A printer as claimed in claim 37, wherein the frame has an elongated channel formed therein which receives a portion of the housing, and wherein the first crank arm imparts force to the housing thereby moving the housing along the channel.

42. A printer as claimed in claim 41, wherein the elongated channel has opposite first and second ends, and an intermediate portion, and wherein the first crank arm moves the housing along the channel between the first and second ends thereof.

43. A printer as claimed in claim 42, wherein the housing, when moving along the channel between the first and second ends thereof, defines given operational conditions of the printer, and wherein the housing, when positioned at the first end of the channel defines a printing condition, and wherein the housing when disposed in the intermediate portion of the channel defines a cleaning condition, and wherein the housing when positioned at the second end of the housing defines a non-printing condition.

44. A printer as claimed in claim 43, wherein in the printing condition the first, second, and third rotatable drums are in contact with each other, the first and second exhaust drums are in contact with each other, and the cleaning drum is in contact with the second rotatable drum.

45. A printer as claimed in claim 44, wherein in the cleaning condition the first and second exhaust drums remain in force engaging contact, one with the other.

46. A printer as claimed in claim 45, wherein in the non-printing condition the second rotatable drum is spaced from the first rotatable drum, the second exhaust drum is spaced from the first exhaust drum and the cleaning drum is spaced from the second rotatable drum, and wherein the housing is moveable along a given path of travel to a position which permits removal of the second rotatable drum.

47. A printer as claimed in claim 46, wherein the articulation assembly comprises a second crank arm which is borne by the crank and which is disposed in force transmitting relation relative to the shutters.

48. A printer as claimed in claim 47, wherein the second crank arm positions the shutters in an open position when the printer is in the printing condition, and a closed condition when the printer is in the non-printing condition, the shutters when disposed in the closed condition impairing the transmission of heat from the heater.

49. A printer as claimed in claim 48, wherein the first and second crank arms are spring biased.

50. A printer comprising:

a frame;

a moveable lifting member borne by the frame;

a rotatable pressure drum borne by the frame;

a rotatable fusing drum borne by the lifting arm;

a rotatable image drum borne by the frame and positioned in contact with the fusing drum;

an articulation assembly pivotally borne by the frame and moveable along a course of travel, the lifting arm engaging the articulation assembly, and wherein movement of the articulation assembly imparts movement to the lifting arm, the lifting arm carrying the fusing drum along a given course of travel, into and out of contact with the pressure drum; and an image forming assembly borne by the frame and oriented adjacent to the image drum.

51. A printer as claimed in claim 50, wherein the lifting member has a main body having opposite first and second ends, and wherein the first end is pivotally secured on the frame, and the second end engages the articulation assembly and is moveable along an arcuately shaped path of travel.

52. A printer as claimed in claim 51, and wherein the articulation assembly further comprises:

a housing movably borne by the frame;

a crank borne by the housing;

a motor disposed in force transmitting relation relative to the crank; and a first crank arm borne by the crank and disposed in force transmitting relation relative to the housing.

53. A printer as claimed in claim 52, wherein the frame has an elongated channel formed therein and which has opposite first and second ends, and wherein the housing is slidably received in the channel and is reciprocally moveable therealong between the first and second ends when force is imparted to the housing by the first crank arm, and wherein movement of the housing from the first to the second end defines various operational conditions of the printer.

54. A printer as claimed in claim 53, and further comprising:

a first rotatable exhaust drum borne by the frame;

a second rotatable exhaust drum borne by the housing; and a cleaning drum borne by the housing.

55. A printer as claimed in claim 54, wherein the operational conditions of the printer include first, second and third conditions, and wherein in the first condition the housing is positioned at the first end of the elongated channel, and wherein in the second operational condition the housing is disposed intermediate the first and second ends of the elongated channel, and wherein in the third operational condition the housing is disposed at the second end of the elongated channel.

56. A printer as claimed in claim 55, wherein in the first operational condition the fusing drum is in contact with the pressure drum and the image drum, the first and second exhaust drums are in contact, one with the other, and the cleaning drum is in contact with the fusing drum, and wherein in the third operational condition the fusing drum is disposed in spaced relation relative to the pressure drum, the cleaning drum is disposed in spaced relation relative to the fusing drum, and the second exhaust drum is disposed in spaced relation relative to the first exhaust drum.

57. A printer as claimed in claim 56, and further comprising:

a media engagement assembly positioned operatively adjacent the pressure drum;

heater assemblies individually disposed in heat transferring relation relative to the media engagement assembly and the rotatable fusing drum; and a shutter borne by the heater engagement assembly, the shutter moveable to given orientations relative to the heater assembly to impede the transmission of heat to the media engagement assembly.

58. A printer as claimed in claim 57, and further comprising a second crank arm borne by the crank and disposed in force transmitting relation relative to the shutter, the shutter moveable between a first, open orientation, and a second closed orientation.

59. A printer as claimed in claim 58, wherein in the first operational condition the second crank arm imparts force to the shutter to position it in the open orientation relative to the heater assembly, and wherein in the open orientation, heat is imparted to the media engagement assembly, and wherein in the third operational condition the second crank arm imparts force to the shutter to position it into the closed orientation, and wherein in the closed orientation the shutter substantially impedes the transmission of heat from the heater assembly to the media engagement assembly.

60. A printer comprising:

a frame;

a moveable lifting member borne by the frame;

a rotatable pressure drum borne by the frame and which is maintained at a first given temperature;

a rotatable fusing drum borne by the lifting arm and which is maintained at a second given temperature;

a rotatable image drum borne by the frame and positioned in contact with the fusing drum, the image drum maintained at a third given temperature;

an articulation assembly pivotally borne by the frame and moveable along a course of travel, the lifting member engaging the articulation assembly, and wherein movement of the articulation assembly imparts movement to the lifting member, the lifting member carrying the fusing drum along a given course of travel into and out of contact with the pressure drum, the movement of the articulation assembly defining various operational conditions of the printer;

a first rotatable exhaust drum borne by the frame;

a second rotatable exhaust drum borne by the articulation assembly;

an image forming assembly borne by the frame and oriented adjacent to the image drum;

a media engagement assembly positioned operatively adjacent the pressure drum and moving a given media in an appropriate direction relative to the pressure drum;

a first heater assembly mounted in heat transferring relation relative to the rotatable fusing drum;

a second heater assembly disposed in heat transferring relation relative to the media engagement assembly; and a toner dispensing assembly mounted adjacent to the image drum.

61. A printer as claimed in claim 60, and further comprising a rotatable cleaning drum movably borne by the articulation assembly and positioned in contact with the fusing drum.

62. A printer as claimed in claim 61, wherein the pressure drum is maintained at a temperature of less than about 90° C.

63. A printer as claimed in claim 62, wherein the fusing drum is maintained at a temperature of less than about 140° C.

64. A printer as claimed in claim 63, wherein the image drum is maintained at a temperature of less than about 70° C., and wherein the image drum and the fusing drum have a surface energy which is substantially equal.

65. A printer as claimed in claim 64, wherein individual temperature sensors are mounted in spaced relation relative to the image drum and the fusing drum, each of the temperature sensors being enclosed within a heat sink which maintains the respective temperature sensor at a temperature of about 50 to about 60° C.

66. A printer as claimed in claim 65, wherein the articulation assembly comprises:

a housing pivotally borne by the frame, and moveable along a given course of travel;

a crank borne by the frame;

a first crank arm borne by the crank and disposed in force transmitting relation relative to the housing; and means for imparting predetermined rotational movement to the crank.

67. A printer as claimed in claim 66, wherein the frame has an elongated channel formed therein which receives the housing, the elongated channel having opposite first and second ends and an intermediate portion, and wherein the first crank arm moves the housing along the channel between the first and second ends.

68. A printer as claimed in claim 67, wherein the housing, when moving along the channel between the first and second ends thereof defines given operational conditions of the printer, and wherein the housing, when positioned at the first end of the channel defines a printing condition, and wherein the housing when disposed in the intermediate portion of the channel defines a cleaning condition, and wherein the housing when positioned at the second end of the housing defines a non-printing condition.

69. A printer as claimed in claim 68, wherein in the printing condition the fusing drum remains in contact with the pressure and image drums, the first and second exhaust drums are in contact with each other, and the cleaning drum is in contact with the fusing drum.

70. A printer as claimed in claim 69, wherein in the non-printing condition the fusing drum is spaced from the pressure drum, the second exhaust drum is spaced from the first exhaust drum, and the cleaning drum is spaced from the fusing drum, and wherein the housing is moveable along a given path of travel to a position which permits removal of the fusing drum.

71. A printer as claimed in claim 70, wherein the second heater assembly further comprises a moveable shutter, and wherein the articulation assembly comprises a second crank arm which is borne by the crank and which is disposed in force transmitting relation relative to the shutter.

72. A printer as claimed in claim 71, wherein the second crank arm positions the shutter in an open position when the printer is in the printing condition, and a closed condition when the printer is in the non-printing condition, the shutter when disposed in the closed condition impairing the transmission of heat energy from the heater.

73. A printer as claimed in claim 72, wherein the toner dispensing assembly has an intake and an exhaust end, and wherein the exhaust end includes a vibration assembly for imparting vibratory motion to the toner received at the exhaust end.

74. A printer comprising:

a frame having a channel formed therein;

a moveable lifting arm borne by the frame;

a rotatable pressure drum borne by the frame;

a rotatable fusing drum borne by the lifting arm;

a rotatable image drum borne by the frame and positioned in contact with the fusing drum;

a housing received in the channel and moveable therealong to define various operational conditions of the printer, and wherein the lifting arm engages the housing, and wherein movement of the housing along the channel causes the lifting arm to carry the rotatable fusing drum into and out of contact with the pressure drum;

a crank borne by the frame;

a motor disposed in force transmitting relation relative to the crank;

a first crank arm borne by the crank and disposed in force transmitting relation relative to the housing;

a second crank arm borne by the crank;

a first rotatable exhaust drum borne by the frame;

a second rotatable exhaust drum borne by the housing;

an image forming assembly borne by the frame and oriented adjacent to the image drum;

a media engagement assembly positioned operatively adjacent the pressure drum;

a first heater assembly disposed in heat transferring relation relative to the rotatable fusing drum;

a second heater assembly having a shutter, and which is disposed in heat transferring relation relative to the media engagement assembly and wherein the second crank arm is disposed in force transmitting relation relative to the shutter; and a toner dispensing assembly mounted adjacent to the image drum.

* * * * *